US008602374B2

(12) United States Patent
Jerg et al.

(10) Patent No.: US 8,602,374 B2
(45) Date of Patent: Dec. 10, 2013

(54) FLOOR-MOUNTED HOUSEHOLD APPLIANCE WITH BALANCE WEIGHT

(75) Inventors: Helmut Jerg, Giengen (DE); Michael Rosenbauer, Reimlingen (DE); Bernd Schessl, Dillingen (DE); Ernst Stickel, Giengen (DE); Martin Stickel, Giengen/Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 43 days.

(21) Appl. No.: 12/743,247

(22) PCT Filed: Oct. 27, 2008

(86) PCT No.: PCT/EP2008/064540

§ 371 (c)(1),
(2), (4) Date: May 17, 2010

(87) PCT Pub. No.: WO2009/068382

PCT Pub. Date: Jun. 4, 2009

(65) Prior Publication Data

US 2010/0282940 A1 Nov. 11, 2010

(30) Foreign Application Priority Data

Nov. 26, 2007 (DE) ..... 10 2007 056 706

(51) Int. Cl.
*A47B 97/00* (2006.01)

(52) U.S. Cl.
USPC ..... 248/364; 248/505; 248/506

(58) Field of Classification Search
USPC ..... 248/500, 505, 506, 682, 364; 206/588, 206/591, 592
See application file for complete search history.

(56) References Cited

U.S. PATENT DOCUMENTS

| | | | | |
|---|---|---|---|---|
| 3,580,014 | A | 5/1971 | Mazza | |
| 3,747,887 | A * | 7/1973 | Binkley | 248/501 |
| 4,890,813 | A * | 1/1990 | Johnson et al. | 248/680 |
| 5,741,054 | A | 4/1998 | Becker et al. | |
| 5,984,101 | A * | 11/1999 | Zamora et al. | 206/586 |
| 8,065,838 | B2 * | 11/2011 | Hockman | 52/25 |

FOREIGN PATENT DOCUMENTS

| | | | |
|---|---|---|---|
| CN | 1552278 | A | 12/2004 |
| CN | 1875873 | A | 12/2006 |
| DE | 3222479 | A1 | 12/1983 |
| DE | 4446961 | A1 | 7/1996 |
| DE | 29704969 | U1 | 6/1997 |
| DE | 10240364 | B3 | 3/2004 |
| FR | 2465460 | | 3/1981 |

OTHER PUBLICATIONS

Report of Examination CN 200880117844.7.

* cited by examiner

*Primary Examiner* — Steven Marsh
(74) *Attorney, Agent, or Firm* — James E. Howard; Andre Pallapies

(57) ABSTRACT

A floor-mounted household appliance including at least one balance weight suitable for preventing the floor-mounted household appliance from tipping over, in particular, by a shift in the center of gravity of the household appliance. In an exemplary embodiment, the balance weight may be provided with two opposing surfaces for force absorption that may occur when the appliance is clamped by a gripper when transported or moved.

5 Claims, 3 Drawing Sheets

FLOOR-MOUNTED HOUSEHOLD APPLIANCE WITH BALANCE WEIGHT

BACKGROUND OF THE INVENTION

Floor-mounted household appliances, such as dishwashers or washing machines, tumble dryers or even refrigerators for example, have a receiving compartment, which can be configured in the case of a dishwasher as the wash container for washing items to be washed, in the case of a washing machine as the tub for washing laundry, in the case of a tumble dryer as the chamber for drying laundry and in the case of a refrigerator as the refrigeration compartment.

The treatment container is typically enclosed by an appliance housing, which comprises a rear housing wall and two lateral housing walls. Floor-mounted household appliances that are not intended to be built under other structures, in other words which can be freestanding, are also provided with an upper housing wall, which in the case of dishwashers is embodied as a worktop for example. The treatment container can be opened and closed for example by way of a front door that can fold down to the front, thereby allowing access to the treatment compartment enclosed by the treatment container. The treatment container is also generally provided with pull-out racks to be loaded with the items to be treated.

When such a rack is pulled out from the treatment container for loading with items to be treated, the center of gravity of the floor-mounted household appliance is displaced. This is particularly so for dishwashers with pull-out racks to be filled with items to be washed, which can displace the center of gravity so far forward when being loaded with items to be washed that there is a risk of the dishwasher tipping forward.

If floor-mounted household appliances with pull-out racks to be loaded with items to be treated are built under a worktop in the manner of built-under appliances, there are generally no problems with regard to stability. But if such floor-mounted household appliances are freestanding, special precautions have to be taken to increase stability.

In order to prevent floor-mounted household appliances with pulled out racks from tipping over, it is known to integrate special balance weights, for example solid concrete or gray iron elements (see for example DE 32 22 479 A1). It is also known to provide hollow bodies that can be filled with small-format bulk solids as shown for example in DE 297 04 969 U1 to increase the stability of dishwashers.

In industrial batch production it is necessary to transport the fully assembled floor-mounted household appliances for storage and dispatch purposes, with what are known as clamp stackers generally being used for the purpose. These are stacker vehicles, which grip the lateral housing walls of the floor-mounted household appliances in a clamping manner with tong-type grippers. Since the lateral housing walls are generally relatively thin, it is possible for them to be dented by the clamping grip. Special precautions therefore have to be taken to prevent plastic deformation of the lateral housing walls.

For example flat force absorbers are known for this purpose from DE 44 46 961 C2, serving to absorb and distribute the mechanical forces occurring with the clamping grip at the lateral housing walls. The flat force absorbers are positioned respectively at the corners of the treatment container between a housing frame and the housing cover or between the treatment container and the housing frame. They distribute the forces occurring with the clamping grip to a larger working surface, feed them into the housing frame and thereby prevent plastic deformation of the housing walls.

Until now separate facilities have been provided respectively in such floor-mounted household appliances to prevent damage to the appliance housing during transportation by clamp stackers and to increase stability, this being associated with relatively high material and manufacturing costs and requiring corresponding structural space.

There is therefore a demand for a floor-mounted household appliance with a treatment container with pull-out racks, which can be transported by a clamp stacker without damage and when freestanding is stable even when the center of gravity is displaced by pulling out the in particular loaded racks but can be manufactured with fewer parts compared with conventional floor-mounted household appliances with such characteristics, with the result that material and manufacturing costs can be saved.

BRIEF SUMMARY OF THE INVENTION

According to the proposal of the invention this object is achieved by a floor-mounted household appliance.

The position details given in the description of the invention, such as front, rear, top, bottom, horizontal and vertical, relate to a floor-mounted household appliance installed on a horizontal surface and only serve to illustrate the invention in a simpler manner without thereby restricting the invention.

The inventive floor-mounted household appliance has a balance weight, the weight of which prevents the floor-mounted household appliance tipping over. The floor-mounted household appliance here, as in the case of a dishwasher for example, can have a rack for holding items to be washed, which can be pulled out from the treatment container for the purposes of loading and unloading, thereby causing displacement of the center of gravity. For this purpose the balance weight has an appropriate weight compared with the overall weight of the floor-mounted household appliance and can for example have a weight that is at least 10% or at least 20% of the overall weight of the floor-mounted household appliance.

The balance weight is configured as monolithic (a single piece) and rigid. It is essentially characterized in that it is provided with two opposing surfaces for force absorption when the floor-mounted household appliance is gripped in a clamping manner. For this purpose the balance weight in particular comprises a first segment providing the one surface, being disposed between the treatment container and a first housing wall, in particular a lateral housing wall, of the appliance housing, a second segment providing the second surface, being disposed between the treatment container and a second housing wall, in particular a lateral housing wall, of the appliance housing opposite the first housing wall, as well as a third segment, which connects the first segment and the second segment together in a rigid manner.

The housing walls of the appliance housing advantageously lie against the first segment and/or the second segment. Alternatively they can be made to lie against these two segments by elastic deformation.

The balance weight, which serves as a weight balance when the rack is pulled out, can thus also advantageously serve as a force absorber for absorbing mechanical forces from the in particular lateral clamping grip by a gripper of a clamp stacker acting on the housing walls. Since the balance weight has both the function of a balance weight and the function of a force absorber, there is no need for a separate force absorber to absorb mechanical forces from the clamping grip, thereby saving material and manufacturing costs compared with conventional generic floor-mounted household appliances. Also there is no need to reserve additional structural space for a separate force absorber.

In one advantageous embodiment of the inventive floor-mounted household appliance the third segment of the balance weight is disposed between the treatment container below an upper housing wall, for example a worktop in the case of a free-standing dishwasher. In this instance in particular it is particularly advantageous if the balance weight is disposed adjacent to the rear wall or in the region of the rear wall of the appliance housing, since it is possible in this manner to achieve a particularly substantial weight balancing effect.

In a further advantageous embodiment of the invention the balance weight has a fourth segment disposed between the rear housing wall and the treatment container, being connected rigidly to the first segment and the second segment by way of the third segment. This allows the use of otherwise in some instances free rear structural space to allow the balance weight to achieve an even better weight balancing effect. It is also advantageous in this respect if an apron is formed on the fourth segment.

The balance weight can be produced for example as a solid cast element, in particular as a cast concrete element or gray iron element. According to the invention it is preferable if the balance weight is configured in the form of a hollow body, made of plastic for example, that can be filled with (small-format) bulk solids, for example sand, grit, glass, scrap metal, by way of a corresponding opening. Force absorption and force distribution during the in particular lateral clamping grip in this instance take place by way of the filler present in the hollow space.

In a further advantageous embodiment of the inventive floor-mounted household appliance the balance weight has a form tailored to the outer form of the treatment container. In this instance at least the third segment of the balance weight particularly advantageously lies flat against the treatment container so that the high density and large mass of the balance weight advantageously allow noise dampening (reduction of structure-borne sound) of the household appliance to be achieved. To this end the first, second and fourth segments also advantageously lie flat against the treatment container. There is then no need for separate precautions to reduce structure-borne sound.

The invention also extends to a balance weight of an inventive floor-mounted household appliance as described above.

BRIEF DESCRIPTION OF THE DRAWINGS

The invention is described in more detail below based on an exemplary embodiment, with reference to the accompanying drawings, in which.

DETAILED DESCRIPTION OF EXEMPLARY EMBODIMENTS OF THE PRESENT INVENTION

Figure 1:
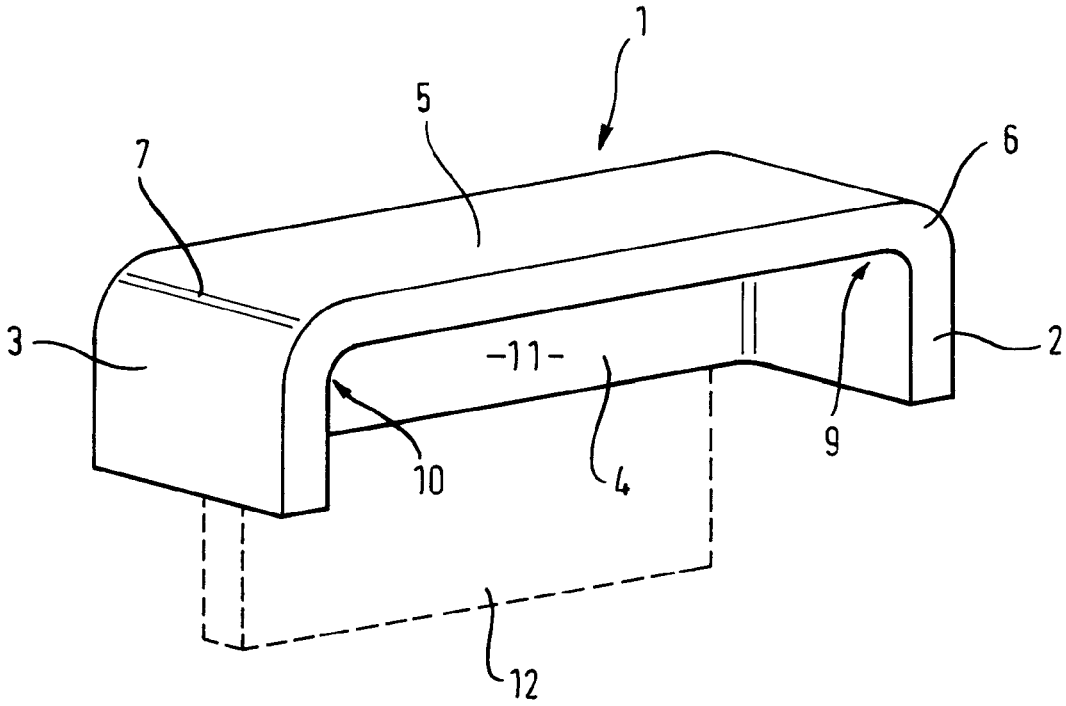
FIG. 1 shows a schematic perspective view of an exemplary embodiment of the inventive balance weight.
Figure 2:
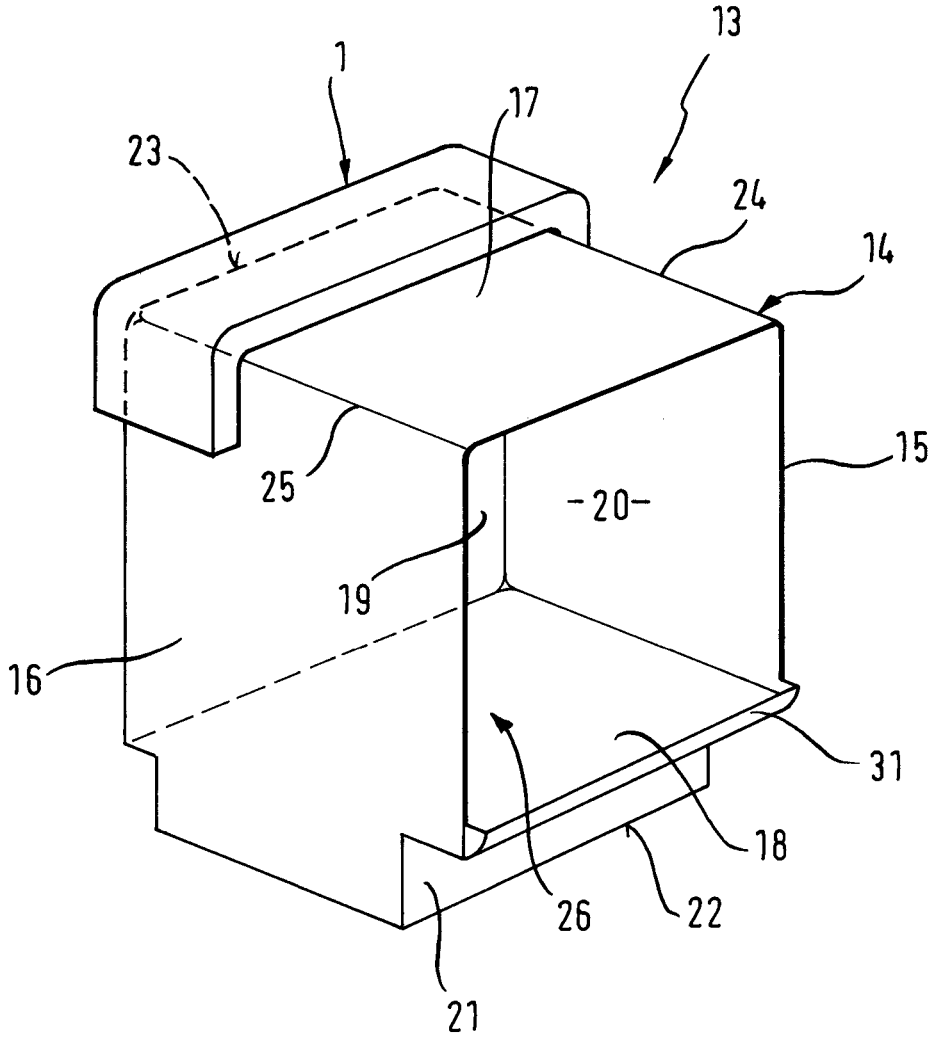
FIG. 2 shows a schematic perspective view of an exemplary embodiment of the inventive floor-mounted household appliance with the balance weight from FIG. 1.
Figure 3:
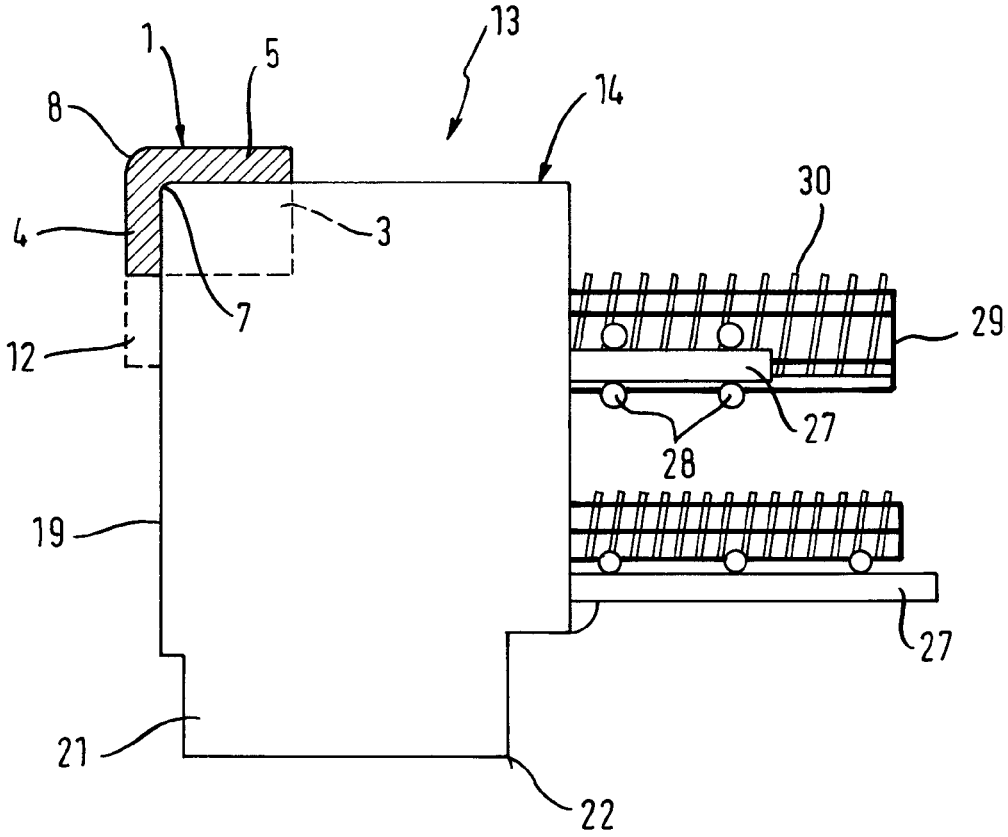
FIG. 3 shows a schematic perspective side view of the floor-mounted household appliance from FIG. 2.

FIG. 1 shows an exemplary embodiment of the inventive balance weight 1, which can be integrated in a floor-mounted household appliance, by way of example a household dishwasher 13 here, only part of which is illustrated in FIGS. 2 and 3.

The single-piece rigid balance weight 1 can theoretically be divided into a number of cuboid surface segments connected to one another by way of curved connecting segments. The cuboid surface segments are a first leg segment 2, a second leg segment 3, a third leg segment 4 and a bridge segment 5. In the installed position the first leg segment 2, the second leg segment 3 and the third leg segment 4 extend respectively in a vertical direction, while the bridge segment 5 extends in a horizontal direction. The first leg segment 2 merges by way of a first connecting segment 6 into the bridge segment 5 and by way of a second connecting segment 7 into the third leg segment 4. The second leg segment 3 merges by way of a third connecting segment 8 into the bridge segment 5 and by way of a fourth connecting segment 9 into the third leg segment 4. Similarly the third leg segment 4 merges by way of the fourth connecting segment 9 into the second leg segment 3, by way of the second connecting segment 7 into the first leg segment 2 and by way of a fifth connecting segment 10 into the bridge segment 5. A cuboid apron 12 that extends vertically downward in the installed position is formed on the third leg segment 4.

The box-shaped wash container 14 of the dishwasher 13 is made of sheet metal or plastic. It comprises a first vertical side wall 15, a second vertical side wall 16, a vertical rear wall 19, a horizontal top wall 17 and a horizontal base wall 18, which together enclose an interior space 20 for receiving items to be washed, which is accessible by way of an opening 26. The wash container 14 stands on the ground by way of a base 21. Not shown in the figures is a front door that can be folded down to the front to open and close the opening 26 of the wash container 14, which is hinged to the wash container 14 for example.

Also not shown in the figures is an appliance housing enclosing the wash container 14, with two lateral housing walls disposed opposite one another and adjacent to the two side walls 15, 16, a rear housing wall disposed opposite and adjacent to the rear wall 19 and an upper housing wall, for example in the form of a worktop, which is disposed opposite and adjacent to the top wall 17.

FIGS. 2 and 3 show the balance weight 1 in its installed position between the wash container 14 and the appliance housing (not shown). The balance weight 1 being a formed element has a form tailored to the box-type outer form of the wash container 14 of the dishwasher 13 and is positioned in the rear region of the wash container 14 with its bridge segment 5 on the top wall 17 of the wash container 14, the wash container 14 essentially filling the hollow space 111 formed by the balance weight 1. The balance weight 1 lies flat against the wash container 14.

In the installed position the bridge segment 5 directly adjoins an upper rear edge 23, at which the top wall 17 merges into the rear wall 19 of the wash container 14. In this process a first upper longitudinal edge 24 of the wash container 14, at which the first side wall 15 merges into the top wall 17, comes to lie adjacent to the first connecting segment 6, so that the first leg segment 2 is disposed adjacent to and opposite the first side wall 15 of the wash container 14. A second upper longitudinal edge 25 of the wash container 14, at which the second side wall 16 merges into the top wall 17, correspondingly comes to lie adjacent to the third connecting segment 8, so that the second leg segment 3 is disposed adjacent to and opposite the second side wall 16 of the wash container 14. Similarly an upper rear edge 23 of the wash container 14 comes to lie adjacent to the fifth connecting segment 10 so that the third leg segment 4 is disposed adjacent to and opposite the rear wall 19 of the wash container 14. The apron 12 formed on the third leg segment 4 extends in a vertical direction into the structural space between the rear housing wall and the rear wall 19 of the wash container 14.

The balance weight 1 consists of a hollow body made for example of plastic, which can be filled with small-format bulk solids, for example gravel, by way of an opening (not shown in detail in the figures). Similarly it would be possible for the balance weight to be configured as a cast element, for example a cast concrete element or gray iron element.

The bridge segment 5 of the balance weight 1 lies against the top wall 17 of the wash container 14. Its specific form means that it can only be raised from the wash container 14 to the rear or upward, which is prevented by the appliance housing. The relatively heavy intrinsic weight of the balance weight 1 means that it is not necessary to secure the balance weight 1 to the wash container 14 or appliance housing further.

As shown in FIG. 3 the dishwasher 13 is provided with racks 27 that can be pulled out on rollers 28, each supporting baskets 29 for holding items to be washed 30. When the racks 27 loaded with items to be washed 30 are pulled out of the interior space 20 of the wash container 14, the center of gravity of the dishwasher 13 is displaced forward. The balance weight 1 located in the rear region of the dishwasher 13 is able to prevent the dishwasher 13 tipping over the front edge 22 of the base 21. To this end the balance weight has a weight that is selected in an appropriate manner for this purpose compared with the overall weight of the dishwasher 13. The balance weight can for example have a weight that is at least 10% or at least 20% of the overall weight of the dishwasher 13.

The balance weight 1 allows laterally clamping gripping of the dishwasher 13 by the gripper of a clamp stacker, without the fear of plastic deformation of the lateral housing walls of the appliance housing. If the dishwasher 10 is gripped in a clamping manner by a clamp gripper at both lateral housing walls of the appliance housing, the balance weight 1 absorbs the mechanical forces acting in this process by way of the first leg segment 2 and the second leg segment 3, these in turn being braced against one another by way of the bridge segment 5 and the third leg segment 4. The lateral housing walls of the appliance housing advantageously lie against the first leg segment 2 or the second leg segment 3. Alternatively they can also be made to lie against the two leg segments 3, 4 by elastic deformation during the clamping grip.

Since the bridge segment 5 of the balance weight 1 in particular lies against the treatment container 14, it is possible to achieve noise damping, in other words the damping of structure-borne sound from the dishwasher 13, by means of the balance weight 1.

LIST OF REFERENCE CHARACTERS

1 Balance weight
2 First segment
3 Second segment
4 Third segment
5 Bridge segment
6 First connecting segment
7 Second connecting segment
8 Third connecting segment
9 Fourth connecting segment
10 Fifth connecting segment
11 Hollow space
12 Apron
13 Floor-mounted household appliance
14 Treatment container
15 First side wall
16 Second side wall
17 Top wall
18 Base wall
19 Rear wall
20 Interior space
21 Base
22 Lower front edge
23 Upper rear edge
24 First upper longitudinal edge
25 Second upper longitudinal edge
26 Opening
27 Rack
28 Roller
29 Basket
30 Items to be washed
31 Strip

The invention claimed is:

1. A floor-mounted household appliance, comprising: at least one balance weight structured wherein a weight of the at least one balance weight effectively functions to prevent the floor-mounted household appliance from tipping over due to a displacement of the floor-mounted appliance's center of gravity, wherein the at least one balance weight includes two opposing surfaces for absorption of opposing axial forces, and wherein the at least one balance weight comprises: a first segment disposed between a treatment container of the floor-mounted household appliance and a first housing wall of the floor-mounted household appliance; a second segment disposed between the treatment container and a second housing wall of the floor-mounted household appliance opposite the first housing wall; a third segment disposed between a rear housing wall of the floor-mounted household appliance and the treatment container; and a bridge segment rigidly connecting the first, second, and third segments together, and wherein the at least one balance weight has a form tailored to the treatment container form, such that the at least one balance weight lies substantially flat against a surface of the treatment container.

2. The floor-mounted household appliance as claimed in claim 1, wherein the bridge segment of the at least one balance weight is disposed between the treatment container and an upper housing wall.

3. The floor-mounted household appliance as claimed in claim 1, wherein the at least one balance weight is disposed adjacent to the rear housing wall.

4. The floor-mounted household appliance as claimed in claim 1, wherein an apron segment is formed on the third segment of the balance weight, wherein the apron segment extends downward from the third segment.

5. The floor-mounted household appliance as claimed in claim 1, wherein the at least one balance weight includes a hollow body structured to be filled with bulk solids.

* * * * *